US005419062A

United States Patent [19]

Polinski et al.

[11] Patent Number: 5,419,062

[45] Date of Patent: May 30, 1995

[54] SPORTS CARD FRAME

[75] Inventors: Russell E. Polinski, Barrington; John K. Morrow, Arlington Heights, both of Ill.

[73] Assignee: Russell Specialties Corporation, Chicago, Ill.

[21] Appl. No.: 72,132

[22] Filed: Jun. 3, 1993

[51] Int. Cl.[6] ..... G09F 1/10

[52] U.S. Cl. ..... 40/124.4; 40/159

[58] Field of Search ..... 40/124, 124.2, 124.4, 40/159, 537; 206/38, 39, 449, 457, 562, 564

[56] References Cited

U.S. PATENT DOCUMENTS

| | | | |
|---|---|---|---|
| 1,835,098 | 12/1931 | Shedd | 40/152.1 X |
| 2,163,978 | 6/1939 | Ivanek | 40/124 X |
| 4,944,968 | 7/1990 | Wagner | 40/159 X |
| 5,046,616 | 9/1991 | Makowski et al. | 40/156 X |
| 5,052,560 | 10/1991 | Stringham | 206/564 |
| 5,087,145 | 2/1992 | Cooley | 206/456 X |
| 5,119,574 | 6/1992 | King | 40/159 X |
| 5,186,566 | 2/1993 | Cameron | 40/159 X |
| 5,203,450 | 4/1993 | Benetti | 206/564 X |

*Primary Examiner*—Brian K. Green
*Attorney, Agent, or Firm*—Thomas R. Vigil

[57] ABSTRACT

The sports card frame is in the shape of an article used in a particular sport. The frame has a front or outer generally planar surface and pockets in the planar surface having structure for holding a plurality of sports cards in a predetermined array. The number of sports cards receiving pockets being equal to the number of players on a team in a particular sport.

10 Claims, 2 Drawing Sheets

SPORTS CARD FRAME

BACKGROUND OF THE INVENTION

1. Field of the Invention

The present invention relates to a sports card frame and more specifically to a home plate shaped, baseball player card receiving and mounting frame for receiving and mounting in a simple and releasable manner a plurality of sports cards such as baseball player cards, for a complete sports team, in an attractive and predetermined array.

2. Description of the Related Art Including Information Disclosed under 37 CFR §§ 1.97–1.99

Heretofore favorite sports player cards cherished by a collector of sport player cards are kept in a box or at times put into a plastic enclosure much like the plastic enclosures for plastic credit cards.

Oftentimes a collector will merely mount his or her favorite sport player card on a planar surface with scotch tape or some other adhesive, such as a glue, and then mount the card on a wall.

This method of mounting one or more favorite/cherished sport player card on a wall has the disadvantage that the scotch tape or glue can damage the card and reduce its value.

As will be described in greater detail hereinafter, the sports card frame of the present invention provides releasable mounting, in a simple manner, of a plurality of sport player cards equal in number to the number of players on a particular sports team in an attractive predetermined array. The sports card frame of the present invention enables the sports player cards, such as baseball player cards, to be mounted without any damage to the cards and with easy removal of each card from the frame for replacement with another sports player card, such as another baseball player card.

SUMMARY OF THE INVENTION

According to the present invention there is provided a sports card frame in the shape of an article used in a particular sport, said frame having a front/outer, generally planar surface and means associated with said planar surface for holding a plurality of sports cards in a predetermined array, the sports cards holding means being constructed and arranged to mount a number of sport player cards equal to the number of players on a team in a particular sport.

DESCRIPTION OF THE PREFERRED EMBODIMENT(S)

Figure 1:
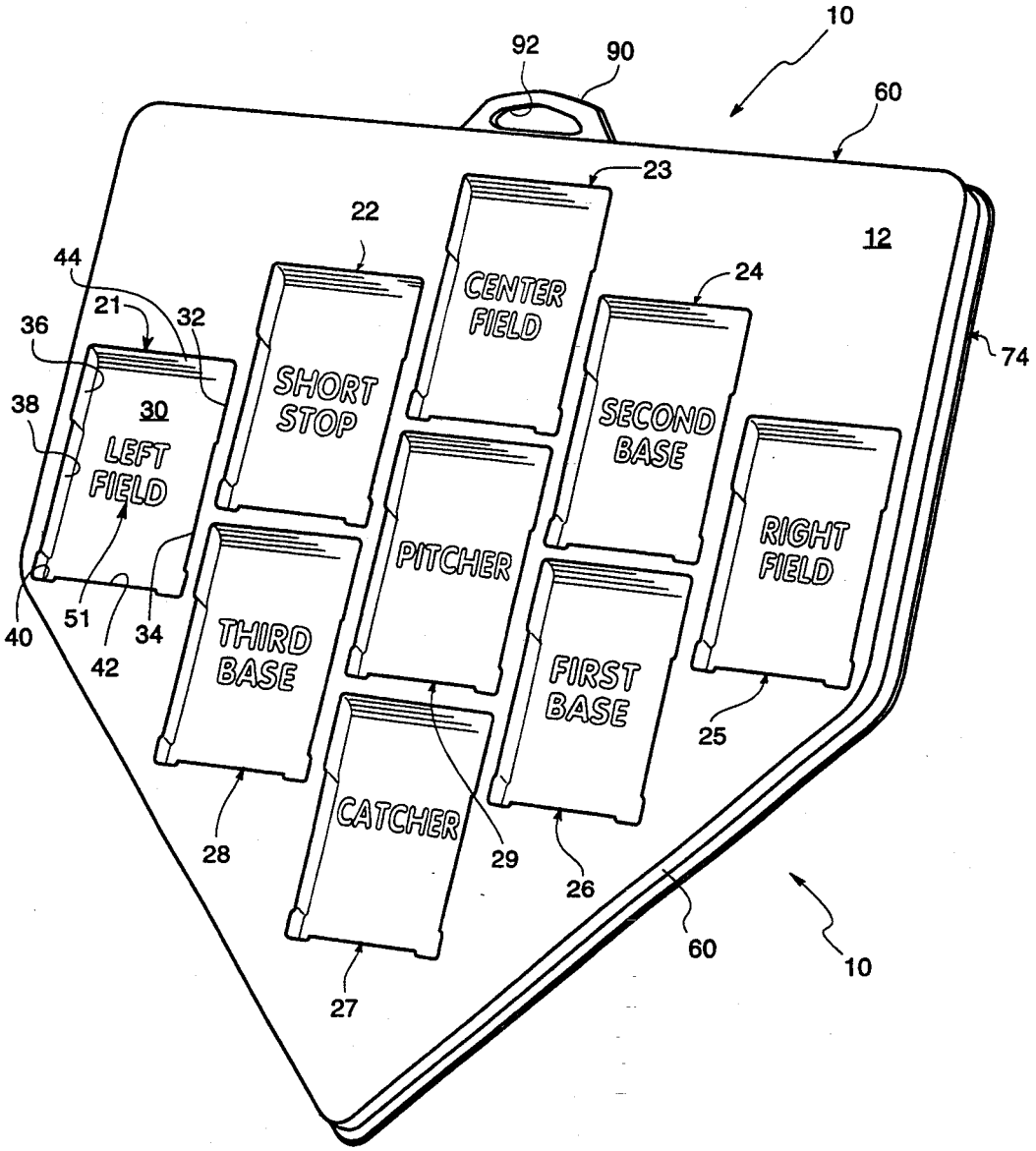
FIG. 1 of the drawings is a front perspective view of a sports card frame constructed according to the teachings of the present invention.

Referring now the drawings in greater detail, there is illustrated in FIG. 1 a perspective view of a sports card frame 10 which is constructed in the general shape of a home plate.

This sports card frame 10 is specifically designed for use with baseball player trading cards and for mounting favorite players to make up a baseball team of favorite players releasably mounted in the frame.

Figure 2:
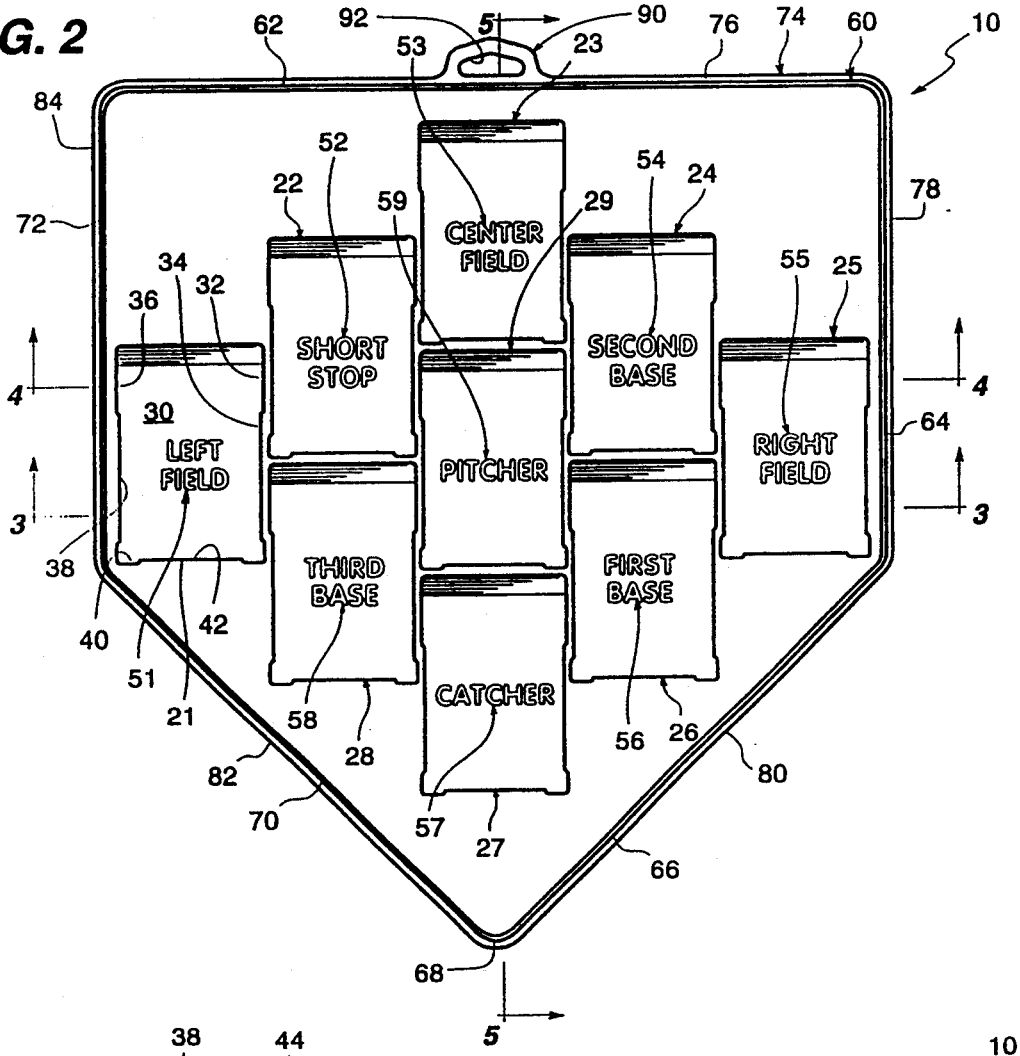
FIG. 2 is a front plan view of the sports card frame shown in FIG. 1.

As shown in FIGS. 1 and 2, the sports card or baseball card frame 10 not only has the general shape of a home plate but has a raised front/outer planar surface 12. Formed in the raised outer planar surface 12 are a plurality of generally rectangular pockets or recesses 21–29.

The pockets 21–29 are arranged in a generally diamond configuration and each pocket or recess 21–29 has a generally flat inner or bottom surface 30, a right side wall 32 with an inclined surface portion 34, a left side wall 36 with an inclined surface portion 38, a bottom wall 40 with an inclined surface portion 42, and a top or upper rounded wall surface 44.

The bottom surface 30 of each pocket or recess 21–29 has indicia 51–59 depressed therein or raised therefrom to indicate a player position for the game of playing baseball.

In this respect, the pocket 21 has the indicia 51, "LEFT FIELD" on the bottom surface 30 thereof.

The pocket 22 has, for the bottom surface indicia 52, "SHORT STOP".

The pocket 23 has, for the bottom surface indicia 53, "CENTER FIELD" on the bottom surface 30 thereof.

The pocket 24 has, for the bottom surface indicia 54, "SECOND BASE" on the bottom surface 30 thereof.

The pocket 25 has, for the bottom surface indicia 55, "RIGHT FIELD" on the bottom surface 30 thereof.

The pocket 26 has, for the bottom surface indicia 56, "THIRD BASE" on the bottom surface 30 thereof.

The pocket 27 has, for the bottom surface indicia 57, "PITCHER" on the bottom surface 30 thereof.

The pocket 28 has, for the bottom surface indicia 58, "FIRST BASE" on the bottom surface 30 thereof.

The pocket 29 has, for the bottom surface indicia 59, "CATCHER" on the bottom surface 30 thereof.

Figure 3:
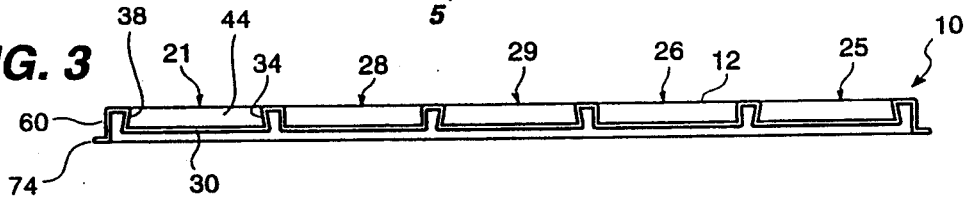
FIG. 3 is a generally horizontal sectional view through the sports card frame shown in FIG. 2 and is taken along line 3—3 of FIG. 2.
Figure 4:
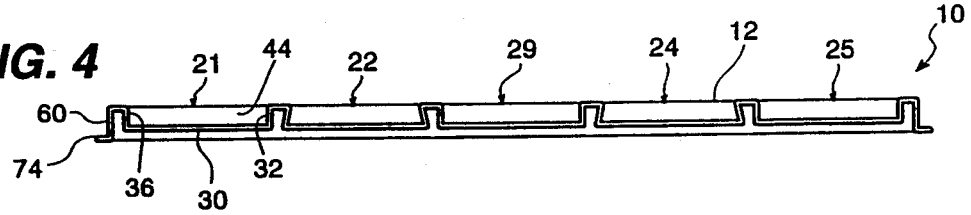
FIG. 4 is a generally horizontal view through the sports card frame shown in FIG. 2 and is taken along line 4–4 of FIG. 2.

As best shown in FIG. 3, the opposed inclined surface portions 34 and 38 of the right side wall 32 and the left side wall 36 of the pocket 21 are inclined inwardly of the pocket 21 and outwardly to the planar surface 14 and provide, along the bottom margins thereof, a holding surface for a baseball card inserted into the pocket 21. Then, as shown in FIG. 5, the bottom wall 42 of each pocket 21–29 has the inclined surface portion 42 which extends upwardly or outwardly to the planar surface and inwardly of the pocket or recess 21–29.

Figure 5:
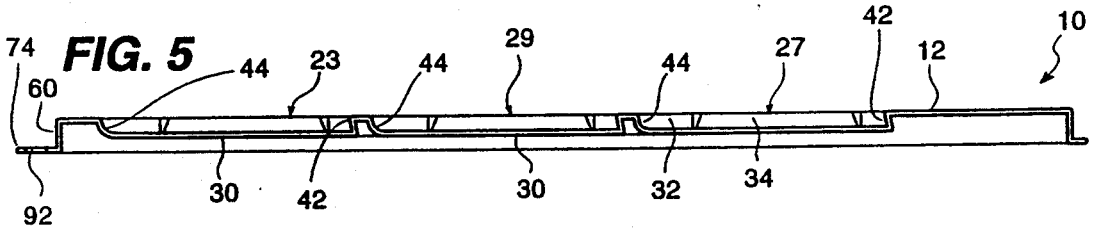
FIG. 5 is a vertical sectional view through the sports card frame shown in FIG. 2 and is taken along line 5—5 of FIG. 2.

Then, as shown in FIGS. 1, 2 and 5, the top or upper wall 44 extends in a curve downwardly and inwardly to the inner or bottom surface 30 of the pocket or recess 21–29. The inclined surface portions 34, 38 and 42 of each pocket 21–29 serves to hold a baseball card in the pocket 21–29.

It will be easy to understand that a baseball card is inserted inwardly along the curved top wall 44 of each pocket or recess 21–29 and then inwardly or downwardly beneath the inclined surface portions 34 and 38 to the bottom wall 40 of the pocket or recess 21–29.

The inclined surface portions 34, 38 and 42 hold the baseball playing card in a pocket or recess 21–29 in a very efficient manner. Furthermore, the curved top wall 44 allows a card to be easily inserted and withdrawn from each pocket 21–29.

The baseball card frame 10 is not only formed in the shape of a home plate but also has a continuous outer side wall 60 including a top wall portion 62, a right side wall portion 64, a lower inclined right side wall portion 66, a rounded lower end 68, a left lower inclined portion 70 and a left wall portion 72. Extending laterally outwardly from the continuous side wall 60 is a flange 74 including a top edge flange portion 76, a right side edge flange portion 78, a lower right flange edge portion 80, a lower left flange edge portion 82 and a left flange edge portion 84.

Extending laterally outwardly or upwardly from the top edge flange portion 76 is a formation 90 having an opening 92 therein to form an eye formation 90 for engaging a nail or screw or string for mounting the sports card frame 10 on a wall.

The baseball card frame 10 is unitary and made as one integral piece from a thermoplastic material or other suitable material and is not only inexpensive to make but also provides an attractive display of a complete sports team, such as a baseball team, in an attractive manner in the frame 10.

If desired, a mating transparent plastic cover can be provided having a home plate shaped planar surface and a depending rim for frictionally engaging the side wall 60 to hold the cover on the frame 10.

Furthermore, the inclined side surface portions 34, 38 and 42 of the side walls 32 and 36 and bottom wall 40 of the pockets or recesses 21–29 provide a very simple and effective non-damaging mechanism for mounting a playing card in each one of the pockets 21–29.

From the foregoing description, it will be apparent that modifications can be made to the sports card frame/baseball card frame 10 of the present invention without departing from the teachings of the invention. Also, it will be apparent that the baseball card frame 10 of the present invention has a number of advantages, some of which have been described above and others of which are inherent in the invention. Accordingly, the scope of the invention is only to be limited as necessitated by the accompanying claims.

I claim:

1. A sports card frame comprising a body having a shape of an article used in a particular sport in which a predetermined number of players participate for each team, said body having an outer generally planar surface and a plurality of receiving and holding means associated with said planar surface for receiving and holding a plurality of sports cards in a predetermined array, said plurality of receiving and holding means including a plurality of generally rectangular pockets or recesses located in the planar surface of the body and having a width and a length, and each pocket or recess being constructed to hold at least one said sports player card therein, each pocket or recess including a bottom wall, opposed side walls defining said width, an upper end wall and a lower end wall defining said length, each said opposed side wall including an inclined wall surface portion that is inclined upwardly and outwardly from said bottom wall toward said planar surface and inwardly of said pocket or recess toward said opposed side wall, said bottom wall connecting said opposed side walls which are adapted to receive therebetween and hold said at least one sports player card along said inclined wall surface portion adjacent said bottom wall, and each of the pockets or recesses having a curved upper end wall surface which extends substantially across the entire width of said pocket or recess and which extends arcuately inwardly and downwardly from said planar surface toward said lower end wall for easily facilitating insertion of a card into and removal of a card from each respective pocket or recess along said curved upper end wall surface without damaging said card, and said lower end wall forming a stop or abutment for limiting insertion of a card inserted into said pocket or recess.

2. The sports card frame of claim 1 wherein said body is in the shape of a home plate for the game of baseball.

3. The sports card frame of claim 1 wherein said plurality of pockets or recesses are equal in number to the player positions for a particular sport.

4. The sports card frame of claim 1 wherein said pockets or recesses are arranged to hold baseball playing cards in a generally diamond or rhombus shaped array in said body about a middle area on said planar surface, with three cards on each side of the diamond or rhombus and a center card in the middle area of the diamond or rhombus in said planar surface.

5. The sports card frame of claim 1 wherein the sport is baseball and there are nine pockets or recesses for receiving nine cards, one for each of the player positions for the sport of baseball.

6. The sports card frame of claim 1 wherein said lower end wall defines an inclined surface with an inner margin extending outwardly from said bottom wall toward said planar surface and inwardly of said pocket or recess towards said curved upper end wall surface for facilitating holding of a bottom edge of a playing card along said inner margin of said inclined surface adjacent said bottom wall.

7. The sports card frame of claim 1 wherein said frame body has an upper side and said upper side has a projection extending outwardly therefrom and having an opening therein to form an eyelet for facilitating hanging of the sports card frame on a wall.

8. The sports card frame of claim 1 including a continuous side wall extending inwardly from said planar surface and completely around said frame.

9. The sports card frame of claim 8 wherein said side wall has an outer edge connected to said planar surface and an inner edge that has a continuous flange extending outwardly therefrom and completely around the sports card frame.

10. The sports card frame of claim 1 wherein said frame is a unitary integral frame and is made of thermoplastic material.

* * * * *